US009981299B2

(12) United States Patent
Asai

(10) Patent No.: US 9,981,299 B2
(45) Date of Patent: May 29, 2018

(54) PUNCH APPARATUS

(71) Applicant: SMC CORPORATION, Chiyoda-ku (JP)

(72) Inventor: Go Asai, Toride (JP)

(73) Assignee: SMC CORPORATION, Chiyoda-ku (JP)

( * ) Notice: Subject to any disclaimer, the term of this patent is extended or adjusted under 35 U.S.C. 154(b) by 259 days.

(21) Appl. No.: 14/781,489

(22) PCT Filed: Apr. 4, 2014

(86) PCT No.: PCT/JP2014/060448
§ 371 (c)(1),
(2) Date: Sep. 30, 2015

(87) PCT Pub. No.: WO2014/168227
PCT Pub. Date: Oct. 16, 2014

(65) Prior Publication Data

US 2016/0038990 A1 Feb. 11, 2016

(30) Foreign Application Priority Data

Apr. 10, 2013 (JP) ..... 2013-082491

(51) Int. Cl.
*B21D 28/00* (2006.01)
*B26D 5/16* (2006.01)
*B26F 1/14* (2006.01)

(52) U.S. Cl.
CPC ..... *B21D 28/002* (2013.01); *B26D 5/16* (2013.01); *B26F 1/14* (2013.01)

(58) Field of Classification Search
CPC .... B21D 28/00; B21D 28/002; B21D 28/005; B26F 1/02; B26F 1/14; B26F 1/04; B26F 1/06; B26F 1/08; B26F 1/10; B26F 1/12
(Continued)

(56) References Cited

U.S. PATENT DOCUMENTS 3,111,055 A * 11/1963 Lubeley ..... B26F 1/08 83/337
3,253,492 A * 5/1966 Petros ..... B23D 15/12 83/557

(Continued)

FOREIGN PATENT DOCUMENTS

CN 202114450 U 1/2012
EP 0 007 776 A1 2/1980

(Continued)

OTHER PUBLICATIONS

Combined Office Action and Search Report dated Jun. 20, 2016 in Chinese Patent Application No. 201480020394.5 (with English language translation).

(Continued)

*Primary Examiner* — Jason Daniel Prone
*Assistant Examiner* — Richard Crosby, Jr.
(74) *Attorney, Agent, or Firm* — Oblon, McClelland, Maier & Neustadt, L.L.P.

(57) ABSTRACT

A punch apparatus includes a drive unit and a driving force transmission mechanism that transmits a driving force output by the drive unit to a rod. In the driving force transmission mechanism, a cam groove is formed in a cam block connected to a piston rod, and a rotating roller, which is pivotally supported on a displacement body connected to the rod, is inserted through the cam groove. The cam groove has a first groove portion and a second groove portion, which are inclined at predetermined angles of inclination with respect to the displacement direction of the cam block. When the rod is made to descend toward the workpiece, the rotating roller moves from the second groove portion into the first groove portion, which has a small angle of inclination, whereby the driving force transmitted to the rod is boosted.

8 Claims, 6 Drawing Sheets

(58) Field of Classification Search
USPC ..... 83/405
See application file for complete search history.

(56) References Cited

U.S. PATENT DOCUMENTS

| | | | | |
|---|---|---|---|---|
| 3,380,284 | A * | 4/1968 | Brener | B21D 28/002 100/282 |
| 3,529,502 | A * | 9/1970 | Krynytzky | B21D 24/14 83/137 |
| 3,623,389 | A | 11/1971 | Krynytzky et al. | |
| 3,724,308 | A * | 4/1973 | Nichols | B26D 5/08 83/557 |
| 3,916,744 | A * | 11/1975 | West | B26F 1/0007 83/175 |
| 4,301,723 | A * | 11/1981 | Borzym | B23D 25/04 100/271 |
| 4,303,012 | A * | 12/1981 | McGlennon | B30B 1/106 100/272 |
| 4,664,004 | A * | 5/1987 | Randall | B26D 7/30 83/125 |
| 4,905,973 | A * | 3/1990 | Blatt | B25B 5/163 269/228 |
| 5,022,297 | A * | 6/1991 | Hommes | B26D 3/10 83/255 |
| 5,706,711 | A * | 1/1998 | Ito | B30B 1/14 700/160 |
| 5,916,345 | A * | 6/1999 | Kobayashi | B30B 1/10 100/272 |
| 6,012,370 | A * | 1/2000 | Kobayashi | B30B 1/14 100/272 |
| 6,386,008 | B1 * | 5/2002 | Virtanen | B21D 5/02 72/19.8 |
| 6,405,625 | B1 * | 6/2002 | Nomura | B41J 15/042 83/214 |
| 6,450,082 | B1 * | 9/2002 | Sawdon | B25B 5/122 60/403 |
| 6,526,800 | B1 | 3/2003 | Virtanen et al. | |
| 7,069,847 | B2 * | 7/2006 | Teraoka | B30B 1/14 100/346 |
| 7,353,685 | B2 * | 4/2008 | Martin | B26D 5/14 100/283 |
| 7,367,210 | B2 | 5/2008 | Nishibu | |
| 2014/0090443 | A1 | 4/2014 | Schmauder et al. | |
| 2016/0038990 | A1 * | 2/2016 | Asai | B21D 28/002 83/628 |

FOREIGN PATENT DOCUMENTS

| | | | |
|---|---|---|---|
| EP | 2 527 058 | A1 | 11/2012 |
| JP | 61-162398 | U | 10/1986 |
| JP | 2002-337095 | A | 11/2002 |
| JP | 2011-37532 | A | 2/2011 |
| SU | 1026898 | A | 7/1983 |
| TW | 418126 | | 1/2001 |
| WO | WO 00/23207 | A2 | 4/2000 |
| WO | WO 2012/160039 | A1 | 11/2012 |

OTHER PUBLICATIONS

International Search Report and Written Opinion dated Jun. 30, 2014 for PCT/JP2014/060448 filed on Apr. 4, 2014.
Office Action dated Mar. 1, 2016 Japanese Patent Application No. 2013-082491 (with partial English language translation).
Combined Office Action and Search Report dated Feb. 22, 2017 in Chinese Patent Application No. 201480020394.5 (with English translation).
Cheng Daxian et al., "Mechanical Design Atlas (vol. 2)", Chemical Industry Press, May 31, 2000, pp. 415-416 with cover pages.
Meng Lingqin et al., "Basic Theory of Machines and Mechanisms", Beijing Institute Technology Press, Jul., 31, 2009, p. 164 with cover pages.
Combined Office Action and Search Report dated Feb. 9, 2017 in Russian Patent Application No. 2015142856/02 (with English translation).
"Mashinostroyeniye" ["Machine Building"], Machine Tools, Guide in 2 volumes, vol. 2, 1984, pp. 582-585 with cover pages.
Combined Office Action and Search Report dated Oct. 16, 2015 in Taiwanese Patent Application No. 103112805 (with English language translation).

* cited by examiner

PUNCH APPARATUS

TECHNICAL FIELD

The present invention relates to a punch apparatus for pushing a rod in an axial direction toward a workpiece under a driving action of a drive unit, for thereby punching a hole, etc., in the workpiece.

BACKGROUND ART

Heretofore, a punch apparatus has been known for punching a hole in a workpiece by pushing a punch with respect to the workpiece in the form of a sheet.

In this type of punch apparatus, for example, as disclosed in U.S. Pat. No. 6,450,082, a sector-shaped cylinder chamber is formed in the interior of a body having two ports, a piston, which is tiltable about an upper end portion thereof serving as a supporting point, is disposed in the interior of the chamber, and a rod is connected through a link, which is supported substantially in a center portion of the piston. One end of the link is supported rotatably on the piston via a pin, and similarly, another end of the link is supported rotatably with respect to the upper end of the rod via a pin. Further, the rod is supported displaceably in a vertical direction in the interior of the body, and on the lower end of the rod, a punch is mounted, which is used when machining is performed on the workpiece.

In addition, a pressure fluid is supplied to one of the ports to thereby cause the other end side of the piston to be tilted upwardly about the one end portion thereof, and in this state a workpiece is set, whereupon the supply of pressure fluid is switched to the other port. Accordingly, the piston is pushed by the pressure fluid supplied into the cylinder chamber, and the other end side of the piston is tilted downward, accompanied by the rod being pushed downwardly through the link, so that a hole-punching process or the like is performed on the workpiece. At this time, by way of a toggle mechanism, which is made up from the link disposed between the piston and the rod, the displacement force of the piston is boosted through the link, and the boosted force is transmitted to the rod.

SUMMARY OF INVENTION

However, with the aforementioned punch apparatus, since the power boost range thereof is narrow when the output power is boosted with respect to the rod by the toggle mechanism, there has been a demand to boost the output power over a wider range, and to perform machining on workpieces more reliably and with a greater output power.

A general object of the present invention is to provide a punch apparatus in which the output from a rod is boosted in power, and in which the power boost range thereof can be expanded.

The punch apparatus of the present invention comprises a body, a drive unit disposed in the body and having a drive shaft that is displaced in an axial direction, a rod disposed at a predetermined angle of inclination with respect to a displacement direction of the drive shaft, the rod being disposed displaceably with respect to the body, and a driving force transmission mechanism by which a driving force output by the drive unit is transmitted to the rod. The driving force transmission mechanism comprises a power boosting mechanism having an inclined portion, which is inclined with respect to the displacement direction of the drive shaft, and the rod is pushed by the inclined portion under a driving action of the drive shaft, whereby the rod is displaced in the axial direction while boosting the driving force.

According to the present invention, in the punch apparatus in which the rod is displaced along the axial direction under a driving action of the drive unit, the driving force transmission mechanism has the power boosting mechanism having the inclined portion, which is inclined with respect to the displacement direction of the drive shaft in the drive unit, and in the power boosting mechanism, the rod is pushed by way of the inclined portion under the driving action of the drive shaft, whereby the rod is displaced in the axial direction while boosting the driving force.

Consequently, by displacement of the drive shaft in the axial direction under the driving action of the drive unit, the driving force is boosted by the inclined portion, the boosted force is transmitted to the rod, and the rod is displaced in a direction that is inclined with respect to the displacement direction of the drive shaft. As a result, the output force applied to the rod is boosted by the power boosting mechanism, and since the boosting thereof takes place over the entire area of the inclined portion, a wider power boosting range can be obtained in comparison with the conventional punch apparatus in which a toggle mechanism is used.

The above and other objects, features and advantages of the present invention will become more apparent from the following description when taken in conjunction with the accompanying drawings in which a preferred embodiment of the present invention is shown by way of illustrative example.

DESCRIPTION OF EMBODIMENTS

Figure 1:
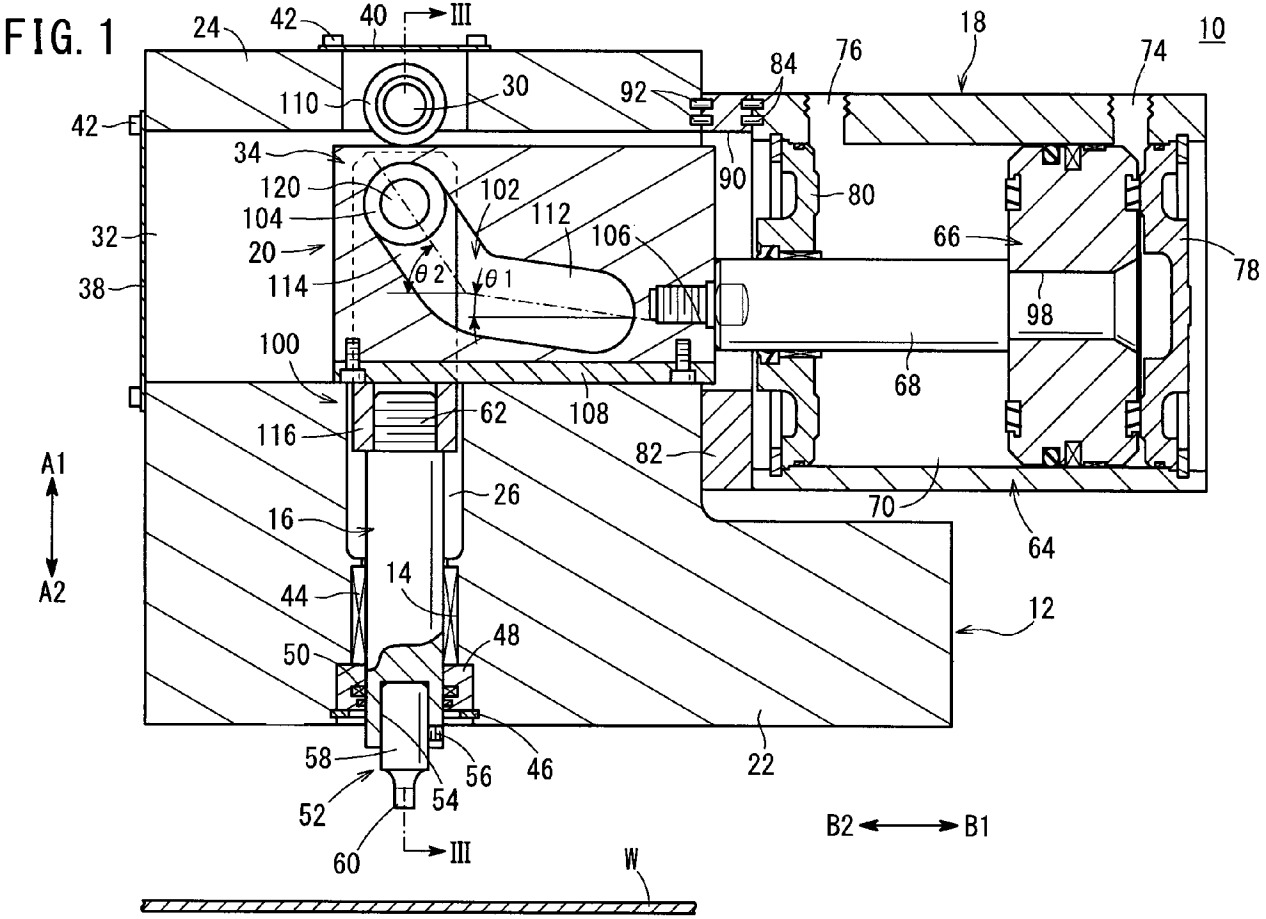
FIG. 1 is an overall cross-sectional view of a punch apparatus according to an embodiment of the present invention.

As shown in FIGS. 1 through 4, a punch apparatus 10 includes a body 12, a rod 16 disposed for displacement along a through hole 14 of the body 12, a drive unit 18 that drives the rod 16, and a driving force transmission mechanism 20 by which a driving force from the drive unit 18 is boosted and transmitted to the rod 16.

The body 12 is equipped with a base portion 22, which is fixed to, for example, a conveying path or the like on which the punch apparatus 10 is installed, and a main body portion 24 that projects upwardly (in the direction of the arrow A1) with respect to the base portion 22. The base portion 22 extends in a horizontal direction (the direction of arrows B1 and B2) and has the through hole 14 formed therein that penetrates through the base portion 22 in a vertical direction (the direction of arrows A1 and A2). The through hole 14 opens on the bottom surface of the base portion 22, extends toward the main body portion 24 (in the direction of the arrow A1), and communicates with a first accommodating hole 26 formed in the main body portion 24.

The main body portion 24 is in the form of a substantially rectangular block, for example, with the first accommodating hole 26 being formed in a substantially central portion in the longitudinal direction thereof. The first accommodating hole 26 extends in a vertical direction (the direction of arrows A1 and A2) and is formed with a rectangular shape in cross section so as to penetrate in a thicknesswise direction through the main body portion 24. More specifically, the first accommodating hole 26 opens on both side surfaces of the main body portion 24, and is formed on a straight line together with the through hole 14 of the base portion 22. In addition, a displacement body 100 and the rod 16, which constitute part of the driving force transmission mechanism 20, are disposed displaceably in the first accommodating hole 26.

A shaft hole 28 is formed upwardly of the first accommodating hole 26 (in the direction of the arrow A1), so as to penetrate in the thicknesswise direction of the main body portion 24. A support shaft 30 that supports a later-described support roller (stopper) 110 is inserted through the shaft hole 28. The shaft hole 28 is separated a predetermined distance with respect to an upper end of the first accommodating hole 26, and penetrates through the main body portion 24 in a horizontal direction substantially perpendicular to the direction in which the first accommodating hole 26 extends.

Further, a second accommodating hole 32 is formed in the main body portion 24, which extends substantially in a horizontal direction (in the direction of the arrows B1, B2) penetrating from one end surface to the other end surface of the main body portion 24. The second accommodating hole 32 has a substantially rectangular shape in cross section, for example, and is formed in a roughly central location in the thicknesswise direction of the main body portion 24. Additionally, the second accommodating hole 32 intersects with the first accommodating hole 26 in the interior of the main body portion 24, and is disposed substantially perpendicular to the direction in which the shaft hole 28 extends.

More specifically, the first and second accommodating holes 26, 32 are formed in crossing relation to one another in the main body portion 24 of the body 12. In addition, a cam block (block body) 34, which constitutes part of the driving force transmission mechanism 20, is disposed displaceably in the second accommodating hole 32.

Portions where the first accommodating hole 26 opens on both side surfaces of the body 12 are closed by attaching first covers 36, respectively, to both side surfaces of the body 12 (see FIG. 3), and as shown in FIG. 1, a portion where the second accommodating hole 32 opens on the other end surface of the body 12 is closed by attaching a second cover 38 to the other end surface. Further, a portion where the first accommodating hole 26 opens on the upper surface of the body 12 is closed by attaching a third cover 40 to the upper surface. The first through third covers 36, 38, 40 are fixed to the body 12 by a plurality of fixing screws 42, respectively.

The rod 16, for example, is constituted from a shaft having a substantially constant diameter. The rod 16 is inserted through the through hole 14 and the first accommodating hole 26 of the body 12, and is supported for displacement along the axial direction (vertical direction, the direction of arrows A1 and A2) by a bush 44, which is disposed in the interior of the through hole 14. A cover ring 48 is installed through a locking ring 46 in an opening of the through hole 14, and a packing 50, which is disposed on the inner circumferential surface of the cover ring 48, is disposed in sliding contact with the outer circumferential surface of the rod 16, so that by sealing the opening, entry of dust or contaminants from the exterior is prevented.

Further, an end of the rod 16 normally projects downward (in the direction of the arrow A2) a predetermined length from the bottom surface of the body 12 and the cover ring 48. An installation hole 54, in which an attachment 52 is mounted, is formed in a center portion of the end of the rod 16. A screw hole in which a retaining screw 56 is screw-engaged, penetrates in a radial direction from the outer circumferential surface of the end of the rod 16. The screw hole penetrates through the end of the rod 16 to the installation hole 54.

The attachment 52, for example, includes a shaft portion 58 formed on a proximal end side thereof (in the direction of the arrow A1) and which is inserted in the installation hole 54, and a machining tool portion 60 on the distal end side thereof (in the direction of the arrow A2). The machining tool portion 60, which is of a circular shape in cross section, is reduced in diameter with respect to the shaft portion 58, and is equipped with a cutting part on the end thereof. Additionally, in a state in which the shaft portion 58 is inserted in the installation hole 54, an end of the retaining screw 56, which is screw-engaged in the screw hole, is placed in pressing abutment against the outer circumferential surface of the shaft portion 58, whereby the attachment 52 is fixed to the distal end of the rod 16.

On the other hand, a connecting portion 62 that is reduced in diameter in a radial inward direction is formed on a proximal end of the rod 16, which is accommodated in the interior of the body 12. Screw threads are engraved on an outer circumferential surface of the connecting portion 62.

The drive unit 18, for example, is a fluid pressure cylinder driven under the supply of a pressure fluid, and includes a cylinder tube 64 formed in a cylindrical shape, a piston 66 disposed displaceably in the interior of the cylinder tube 64, and a piston rod (drive shaft) 68 connected to the piston 66 and which transmits a driving force to the driving force transmission mechanism 20.

Figure 2:
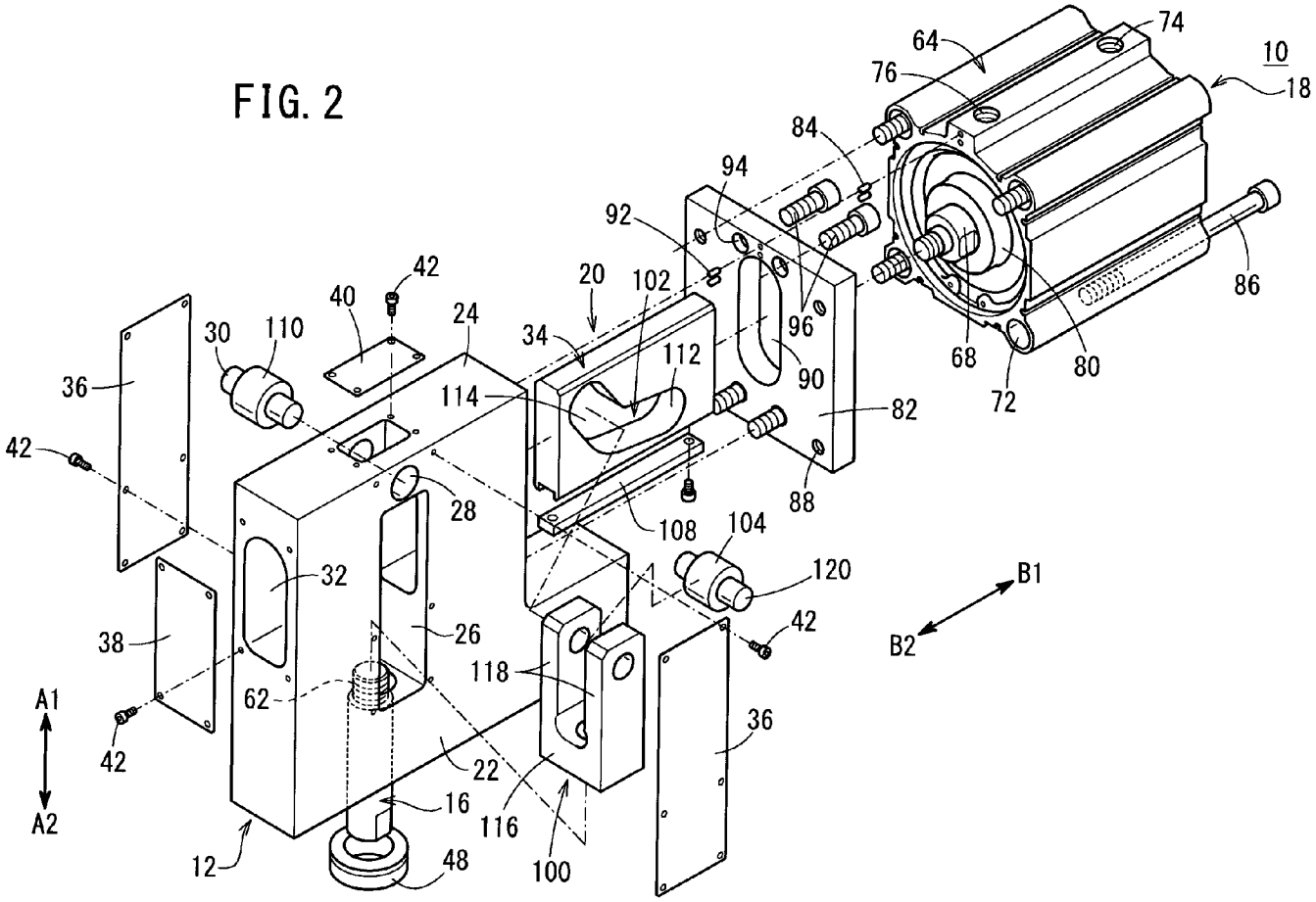
FIG. 2 is an exploded perspective view of the punch apparatus shown in FIG. 1.

A cylinder hole 70, which penetrates in the axial direction (the direction of arrows B1 and B2), is formed in the center of the cylinder tube 64, and as shown in FIG. 2, at four corners on the outer peripheral side of the cylinder hole 70, insertion holes 72 are formed, respectively, which penetrate in the axial direction (the direction of arrows B1 and B2).

Further, first and second ports 74, 76, to which a pressure fluid is supplied and from which the pressure fluid is discharged, are formed on an outer peripheral portion of the cylinder tube 64. The first and second ports 74, 76 communicate with the cylinder hole 70, and non-illustrated tubes are connected respectively to the first and second ports 74, 76. The first port 74 is disposed on one end side (in the direction of the arrow B1) of the cylinder tube 64, and the second port 76 is disposed on the other end side (in the direction of the arrow B2) of the cylinder tube 64.

A head cover 78 is installed on one end of the cylinder tube 64 so as to close the cylinder hole 70, and a rod cover 80 is installed on the other end thereof. Further, an adapter 82, which is formed from a substantially rectangular plate, is placed in abutment against the other end of the cylinder tube 64, and the adapter 82 and the cylinder tube 64 are positioned mutually by a plurality of first locating pins 84. In addition, fastening bolts 86, which are inserted in the insertion holes 72 from the one end side of the cylinder tube 64, are screw-engaged in and connected to screw holes 88, which are formed in the vicinity of the four corners of the adapter 82. A block hole 90, through which the later-described cam block 34 is inserted, is formed substantially in the center of the adapter 82.

Further, the adapter 82 is positioned relatively by second locating pins 92, which are disposed between the adapter 82 and the body 12. Fixing bolts 96, which are inserted through plural bolt holes 94 provided in the vicinity of the screw holes 88, are screw-engaged in an end surface of the main body portion 24 of the body 12 to thereby fix the adapter 82. Accordingly, the drive unit 18 is connected through the adapter 82 to the one end surface of the body 12.

More specifically, the adapter 82 is positioned relatively with respect to the drive unit 18 by the first locating pins 84, and is positioned relatively with respect to the body 12 by the second locating pins 92.

The piston 66 is disposed displaceably in the axial direction (the direction of arrows B1 and B2) in the interior of the cylinder hole 70 between the head cover 78 and the rod cover 80. One end of the piston rod 68 is inserted through a piston hole 98 that penetrates through the center of the piston 66, and is fastened to the piston 66 by caulking or crimping. Consequently, the piston 66 and the piston rod 68 are connected together integrally in a state in which the piston rod 68 projects on the other end surface side (in the direction of the arrow B2) of the piston 66.

One end of the piston rod 68 is connected to the piston 66 in the above-described manner, whereas the other end side thereof (in the direction of the arrow B2) is inserted through the interior of the rod cover 80 and is supported displaceably therein. In addition, the other end of the piston rod 68 projects outside from the other end portion of the cylinder tube 64, and is connected to the later-described cam block 34.

The driving force transmission mechanism 20 includes the cam block 34, which is disposed in the second accommodating hole 32 of the body 12 and is connected to the other end of the piston rod 68, the displacement body 100, which is connected to an upper end of the rod 16 disposed in the first accommodating hole 26, and a rotating roller 104, which is pivotally supported on an end portion of the displacement body 100 and is inserted in a cam groove (inclined portion) 102 of the cam block 34.

The cam block 34, for example, is formed in a block-like shape having a predetermined thickness with a substantially rectangular shape in cross section, and on one end thereof, a coupling hole 106 is provided in which the other end of the piston rod 68 is screw-engaged. The coupling hole 106 is disposed at a position slightly below the center (in the direction of the arrow A2) in the heightwise direction of the cam block 34.

Further, a thin plate bearing member 108 is installed on the bottom surface of the cam block 34, and the bearing member 108 abuts against a bottom wall surface of the second accommodating hole 32. The bearing member 108 is coated on the surface thereof with a lubricant or a material having a low coefficient of friction, which serves to guide the cam block 34 slidably and smoothly in a horizontal direction along the bottom wall surface of the second accommodating hole 32.

On the other hand, the upper surface of the cam block 34 abuts against the support roller 110, which is disposed rotatably in the interior of the first accommodating hole 26, such that when the cam block 34 is displaced, the upper surface of the cam block 34 is guided in a horizontal direction (the direction of arrows B1 and B2) along the second accommodating hole 32. Further, when the displacement body 100 and the rod 16 are lowered to perform machining on the workpiece W, in the case that a reaction force is applied from the workpiece W in a vertically upward direction (the direction of arrow A1) with respect to the displacement body 100 and the rod 16, the support roller 110 functions as a stopper, which is capable of preventing the cam block 34 from being pushed upwardly (in the direction of the arrow A1).

Further, the cam groove 102 that penetrates in the thicknesswise direction is formed in the cam block 34. The cam groove 102 is formed with a substantially constant width, and includes a first groove portion 112, which is formed on a bottom surface side (in the direction of the arrow A2) on one end side (in the direction of the arrow B1) of the cam groove 102, and a second groove portion 114, which is joined to the first groove portion 112 and extends gradually in an upward direction (in the direction of the arrow A1) toward the other end side (in the direction of the arrow B2) of the cam groove 102.

The one end of the first groove portion 112 is formed at substantially the same height as the coupling hole 106. The first groove portion 112 is inclined upwardly (in the direction of the arrow A1) at a first angle of inclination θ1 (see FIG. 1) from the one end toward the other end (in the direction of the arrow B2), and the second groove portion 114 is inclined upwardly (in the direction of the arrow A1) at a second angle of inclination θ2 (see FIG. 1), which is greater than the first angle of inclination θ1 of the first groove portion 112, toward the other end (in the direction of the arrow B2). The first and second angles of inclination θ1, θ2 are defined as angles of inclination with respect to the horizontal direction (the direction of arrows B1 and B2), i.e., the direction in which the cam block 34 is displaced.

More specifically, the cam groove 102 is formed with a step-like shape from the first and second groove portions 112, 114 having different angles of inclination. In addition, the later-described rotating roller 104 is inserted in the cam groove 102.

Figure 3:
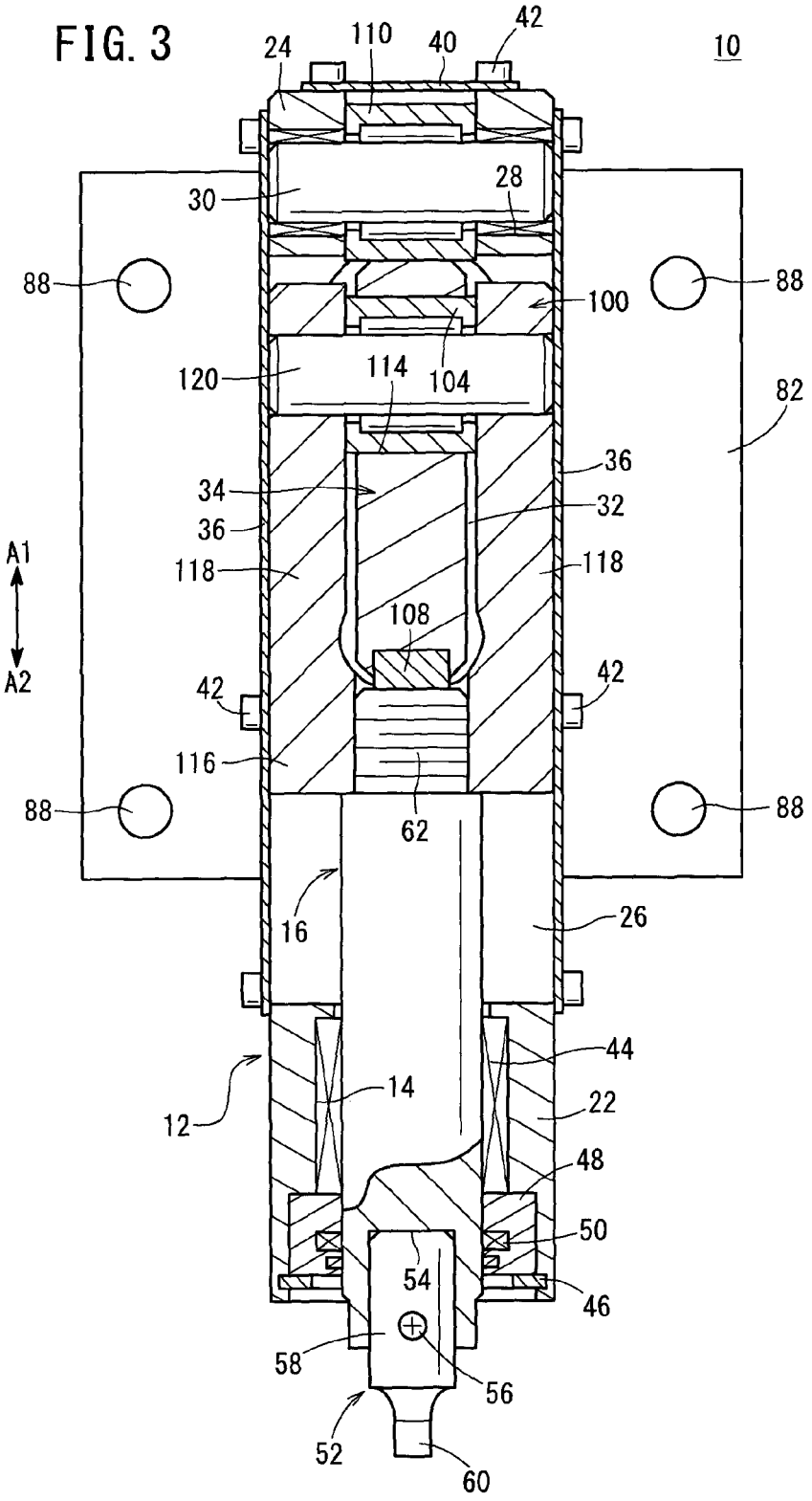
FIG. 3 is a cross-sectional view taken along line III-III of FIG. 1.

As shown in FIGS. 2 and 3, the displacement body 100 includes a bridge portion 116, which is joined to the connecting portion 62 of the rod 16, and yoke portions 118, which project in a bifurcated manner perpendicularly from opposite ends of the bridge portion 116. By connecting the connecting portion 62 to the bridge portion 116, the displacement body 100 and the rod 16 are displaced integrally along the first accommodating hole 26 and the through hole 14 of the body 12.

The yoke portions 118 extend in a direction away from the rod 16, i.e., in an upward direction (in the direction of the arrow A1), and the other end side of the cam block 34 (in the direction of the arrow B2) is inserted through an interior space defined between the yoke portions 118, which are separated mutually by a predetermined distance. Together therewith, the rotating roller 104 is disposed in the cam groove 102, the rotating roller 104 being supported rotatably by a support shaft 120, which is supported in the vicinity of the ends of the yoke portions 118. Accordingly, through the rotating roller 104, the displacement body 100 is kept in a state of engagement with the cam block 34.

The punch apparatus 10 according to the embodiment of the present invention is constructed basically as described above. Next, operations and effects of the punch apparatus 10 will be described. In the following description, the condition shown in FIG. 1, in which the piston 66 of the drive unit 18 is displaced to the side of the head cover 78 (in the direction of the arrow B1), will be described as an initial position, and a case will be described in which a hole-punching process is carried out at a predetermined position on a workpiece W by the attachment 52 that is mounted on the rod 16.

In the initial position, a workpiece W is placed beneath (in the direction of the arrow A2) the attachment 52 that is mounted on the rod 16, and a condition is brought about in which the workpiece W is positioned at a machining site where a hole-punching process is to be performed at a position on a straight line with the attachment 52. In this state, a pressure fluid is supplied through a tube to the first port 74 from a non-illustrated pressure fluid supply source. Consequently, by the pressure fluid, which is introduced into the cylinder hole 70, the piston 66 is displaced (in the direction of the arrow B2) along the cylinder tube 64 toward the rod cover 80, accompanied by the piston rod 68 and the cam block 34 being displaced integrally toward the other end surface side of the body 12 (in the direction of the arrow B2). Further, in this case, the second port 76 is in a state of being open to atmosphere.

In addition, by displacement of the cam block 34 toward the other end surface side (in the direction of the arrow B2) along the second accommodating hole 32, the rotating roller 104, which is positioned at the end of the second groove portion 114 in the cam groove 102, is pushed downwardly by the second groove portion 114, and along therewith, the rod 16 and the displacement body 100 that retains the rotating roller 104 begin to descend downward integrally. More specifically, the driving force in the horizontal direction (the direction of the arrow B2) applied to the cam block 34 is converted into the driving force in a vertical downward direction (the direction of the arrow A2), and is transmitted to the displacement body 100 and the rod 16 by the rotating roller 104, which is engaged with the cam groove 102.

At this time, owing to the bearing member 108 installed on the bottom surface of the cam block 34, the cam block 34 is displaced smoothly and with high accuracy along the bottom wall surface of the second accommodating hole 32, and the rod 16 is guided with high accuracy in a vertical downward direction (the direction of the arrow A2) by the bush 44, which is disposed on the outer circumferential side of the rod 16.

The cam block 34 moves further toward the other end surface side of the body 12 (in the direction of the arrow B2) upon displacement of the piston 66 and the piston rod 68, whereby the displacement body 100 and the rod 16 descend further, and the machining tool portion 60 of the attachment 52 is brought into proximity on the side of the workpiece W, and then the machining tool portion 60 abuts against the surface of the workpiece W. In this case, as a result of the rotating roller 104 being moved from the second groove portion 114 into the first groove portion 112, since the first groove portion 112 is of a smaller angle of inclination than the second groove portion 114 ($\theta 1<\theta 2$), the driving force (output power) applied to the displacement body 100 and the rod 16 and transmitted in the vertical downward direction (in the direction of the arrow A2) becomes greater. More specifically, compared to the condition of engagement of the rotating roller 104 with the second groove portion 114, the driving force, which is transmitted in the vertical downward direction, is boosted.

Stated otherwise, in the cam groove 102, the first groove portion 112 along which the rotating roller 104 is moved functions as a power boosting mechanism for boosting the driving force applied to the displacement body 100, the rod 16, and the attachment 52, and the movement distance of the rotating roller 104 in the interior of the first groove portion 112 serves as a power boosting range in which the driving force is boosted.

Figure 4:
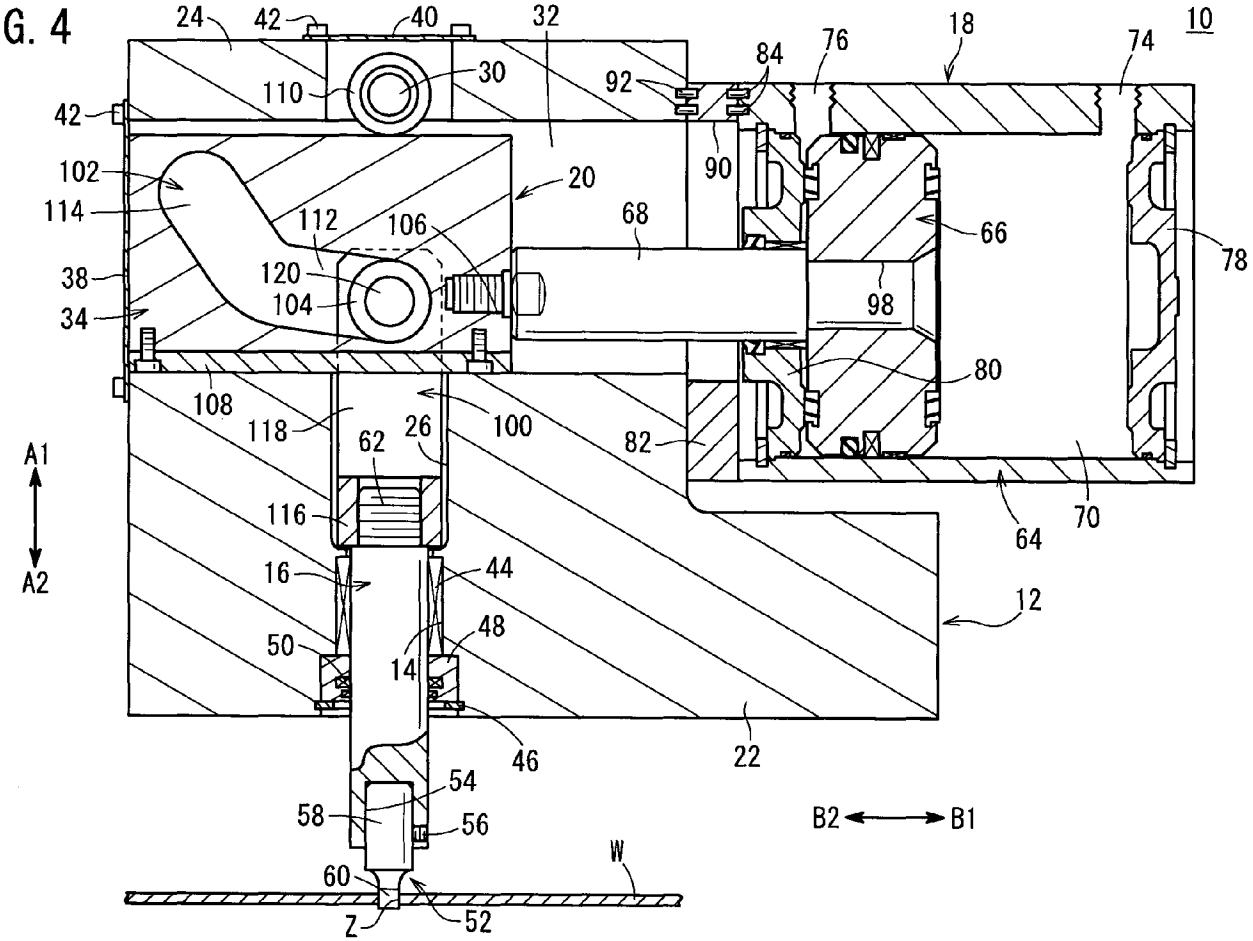
FIG. 4 is an overall cross-sectional view showing a condition in which a drive unit of the punch apparatus of FIG. 1 is driven, a rod is pushed in a downward direction, and machining on a workpiece is carried out.

In addition, by further driving the drive unit 18 in such a condition, in which the driving force thereof is boosted, the rotating roller 104 is moved toward the end of the first groove portion 112, and as shown in FIG. 4, the machining tool portion 60 of the attachment 52 punches out the predetermined site in the workpiece W by the rod 16, thereby forming a punch hole Z that is circular in cross section.

In the process from abutting of the attachment 52 against the surface of the workpiece W to punching the workpiece W, a reactive force from the workpiece W is applied to the attachment 52 in a direction (the direction of the arrow A1) opposite to the pushing direction, and such a reactive force is transmitted to the cam block 34 through the rod 16 and the displacement body 100. However, since upward movement of the cam block 34 (in the direction of the arrow A1) is limited by the support roller 110, which abuts against the upper surface thereof, the cam block 34 is maintained at the predetermined position without the cam block 34 being moved by the reactive force. As a result, even in the case that a reactive force is applied with respect to the cam block 34, the cam block 34 can be displaced with high accuracy along the second accommodating hole 32.

As shown in FIG. 4, after the punch hole Z has been formed at a predetermined position in the workpiece W, under a switching action of a non-illustrating switching device, the pressure fluid, which was supplied to the first port 74, is supplied instead to the second port 76. In this case, the first port 74 is in a state of being open to atmosphere. Accordingly, pressure fluid is supplied between the piston 66 and the rod cover 80, whereupon the piston 66 is pushed toward the head cover 78 (in the direction of the arrow B1). Along therewith, the piston 66, the piston rod 68, and the cam block 34 are displaced together in an integral manner.

In addition, by displacement of the cam block 34, the rotating roller 104 is moved from the first groove portion 112 into the second groove portion 114, whereupon the displacement body 100 and the rod 16 are pulled upwardly (in the direction of the arrow A1), accompanied by the attachment 52 being pulled out upwardly (in the direction of the arrow A1) from the punch hole Z of the workpiece W. Upon further movement of the cam block 34 toward the drive unit 18 (in the direction of the arrow B1) under a driving action of the drive unit 18, the rotating roller 104 is moved to the end of the second groove portion 114, and as shown in FIG. 1, the initial position is restored, in which the displacement body 100 and the rod 16 are moved to their initial upward positions (in the direction of the arrow A1).

Next, differences in the output characteristic of the above-described punch apparatus 10, and the output characteristic of a conventional punch apparatus in which a toggle mechanism is used, will be described with reference to FIG. 5.

First, a brief description will be given of the characteristic curves shown in FIG. 5. In FIG. 5, the displacement amount in the horizontal direction (in the direction of the arrow B2) of the piston 66 of the drive unit 18 and of the cam block 34 in the driving force transmission mechanism 20 is indicated on the horizontal axis, whereas the magnitude of the output force applied from the rod 16 in the vertical downward direction (the direction of the arrow A2) is indicated on the vertical axis. In greater detail, the left side on the horizontal axis indicates a point in time at which displacement of the cam block 34 is started when the rod 16 is driven in the vertical downward direction (the direction of the arrow A2), and a condition is shown in which the displacement amount of the cam block 34 is increased gradually toward the right-hand side, and the rod 16 is pushed in a vertical downward direction (the direction of the arrow A2).

Figure 5:
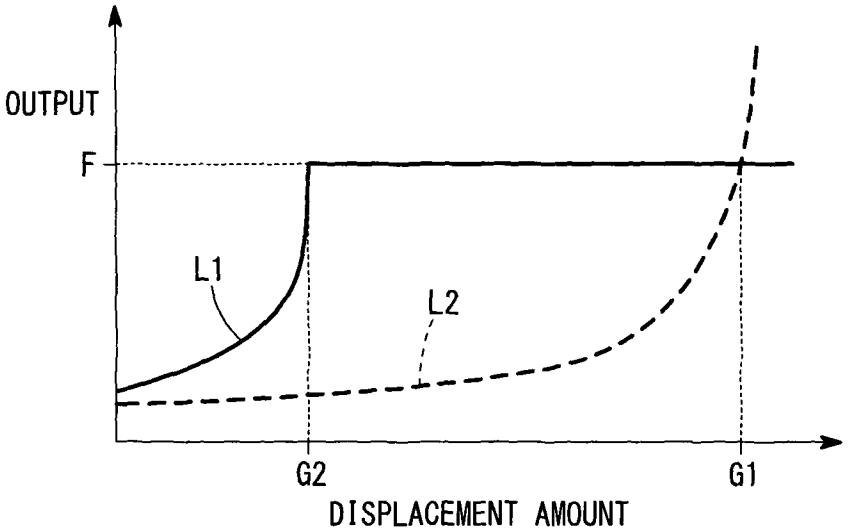
FIG. 5 is a graph of characteristic curves in which an output characteristic of a conventional punch apparatus in which a toggle mechanism is used, and an output characteristic of the punch apparatus shown in FIG. 1 are shown respectively.

Further, in FIG. 5, an output characteristic L1 when the rod 16 is driven toward the workpiece W in the punch apparatus 10 according to the present invention is shown by the solid line, and an output characteristic L2 of the punch apparatus according to the conventional technique is shown by the dashed line.

As shown by the output characteristic L2 (dashed line) of FIG. 5, with the punch apparatus having a toggle mechanism according to the conventional technique, from start of driving of the drive unit, the output begins to increase gradually, and, for example, at a displacement end position G1 where the amount of displacement has reached a predetermined amount, a predetermined output force F needed for processing the workpiece W is reached.

In contrast thereto, as shown by the output characteristic L1 (solid line) of FIG. 5, with the above-described punch apparatus 10 according to the present invention, the cam block 34 starts to move under the driving action of the drive unit 18, and by movement of the rotating roller 104 along the second groove portion 114, the output increases gradually, and then, at a stage G2 (displacement amount) at which the rotating roller 104 moves from the second groove portion 114 into the first groove portion 112, the predetermined output force F needed for processing the workpiece W is reached, and during the period until the cam block 34 reaches the displacement end position G1, the output is maintained constantly at the boosted output force F.

Stated otherwise, with the punch apparatus 10 according to the present invention, it will be appreciated that before the displacement end position G1 is reached, the output is increased to the predetermined output force F, and is maintained at the predetermined output force F.

As a result, as shown by the solid line in FIG. 5, driving of the drive unit 18 is started, and over the entire range (from the displacement amount G2 to the displacement end position G1) from when the rotating roller 104 constituting the driving force transmission mechanism 20 begins to move from the second groove portion 114 into the first groove portion 112 of the cam groove 102 until the rotating roller 104 is moved to the end of the first groove portion 112 and driving of the drive unit 18 is completed, the rod 16 and the attachment 52 can be pushed toward the workpiece W at the boosted constant output force F and machining of the workpiece W can be carried out.

In the foregoing manner, with the present embodiment, the cam block 34 that makes up the driving force transmission mechanism 20 is connected to the other end of the piston rod 68 of the drive unit 18, and the rotating roller 104, which is supported by the displacement body 100 that is connected coaxially with the rod 16, is fitted in engagement with the cam groove 102 of the cam block 34. In addition, the cam groove 102 includes the first groove portion 112, which has the small first angle of inclination θ1, and the second groove portion 114, which has the large second angle of inclination θ2, with respect to the direction of displacement (the direction of arrows B1 and B2) of the cam block 34. By movement of the rotating roller 104 from the second groove portion 114 into the first groove portion 112 under a driving action of the drive unit 18, the output force, which is applied to the displacement body 100 and the rod 16 in a vertical downward direction (the direction of the arrow A2), i.e., toward the workpiece W, is boosted in power. As a result, the driving force output by the drive unit 18 is boosted via the driving force transmission mechanism 20, the boosted force is transmitted to the rod 16, and machining can be carried out on the workpiece W.

Further, compared to the punch apparatus according to the conventional technique in which a toggle mechanism is used, the driving force can be boosted in a range over the length in the axial direction of the first groove portion 112, and the range in which the driving force is boosted can be widened assuredly. As a result, in the case that the attachment 52 is pushed against the workpiece W and machining is carried out thereon, the time over which the boosted output force is applied can be increased.

Furthermore, even if the driving force output by the drive unit 18 is small, the driving force can be boosted through the driving force transmission mechanism 20, the boosted driving force can be transmitted to the rod 16, and the workpiece W can be machined at a desired output. Therefore, for example, even in the event that a large output is required, such a need can be met by a drive unit 18 having a small output force, and the punch apparatus 10 can be made smaller in size.

Further still, by using the driving force transmission mechanism 20 as a wedge mechanism, which is capable of driving the displacement body 100 and the rod 16 vertically downward (in the direction of the arrow A2) through the rotating roller 104 in engagement with the cam groove 102 upon horizontal displacement of the cam block 34, compared to the punch apparatus according to the conventional technique in which power boosting is carried out using a toggle mechanism, the boosting range over which the driving force transmitted to the rod 16 is boosted can be expanded.

Still further, the fluid pressure cylinder that constitutes the drive unit 18 can be attached and detached by screw-rotation of the fastening bolts 86. For this reason, a different drive unit, which has a desired output responsive to the shape and type, etc., of the workpiece W on which machining is to be performed by the punch apparatus 10, can easily be exchanged in responsive to a different workpiece W. Therefore, there is no need to prepare multiple punch apparatus having respective drive units 18 whose output characteristics differ, and with a single punch apparatus 10, simply by suitably exchanging the drive unit 18, machining can be performed on various types of workpieces W that require different output conditions.

Further, in the cam groove 102, by suitably changing the first angle of inclination θ1 of the first groove portion 112 or the length thereof in the axial direction (the direction of arrows B1 and B2), the range over which boosting takes place or the degree of boosting can be set freely.

Furthermore, since the other end of the piston rod 68 of the drive unit 18 is connected at roughly the same height as the end of the first groove portion 112 in the cam block 34, for example, after a hole-punching process has been carried out on the workpiece W, when the piston rod 68 is moved to the one end side (in the direction of the arrow B1) of the drive unit 18 to thereby restore the initial position, a pull-out force, by which the attachment 52 is pulled out from the punch hole Z of the workpiece W, can be transmitted reliably and effectively from the piston rod 68 to the cam block 34.

Figure 6:
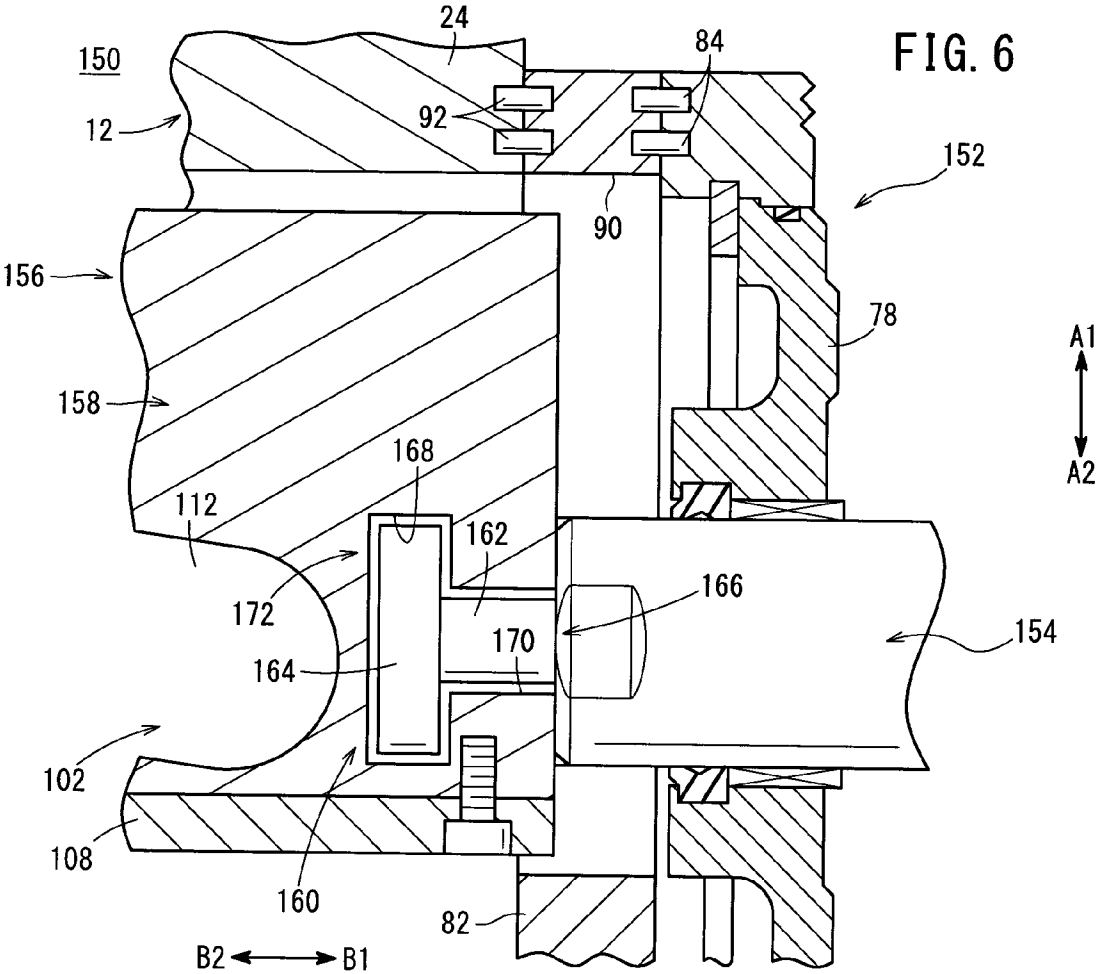
FIG. 6 is an overall cross sectional view of a punch apparatus according to a modification, in which a floating mechanism is provided at a connection site between the drive unit and the driving force transmission mechanism.

On the other hand, as in a punch apparatus 150 according a modification shown in FIG. 6, a floating mechanism 160 may be provided, which is capable of detachably connecting a drive unit 152 and a driving force transmission mechanism 156 at a connection site between a cam block 158 of the driving force transmission mechanism 156 and the piston rod 154 of the drive unit 152.

The floating mechanism 160 includes a first connecting portion 166 constituted from a neck part 162, which is disposed on the other end of the piston rod 154 and is recessed in an annular shape, and a head part 164 formed on a distal end and expanded in diameter with respect to the neck part 162, and a second connecting portion 172 having a first engagement groove 168 provided on an end of the cam block 158 and with which the head part 164 is engaged, and a second engagement groove 170 with which the neck part 162 is engaged.

In addition, by insertion of the head part 164 of the piston rod 154 into the first engagement groove 168 of the cam block 158, and insertion of the neck part 162 into the second engagement groove 170, a state of engagement is established between the head part 164 and the first engagement groove 168, and a connected state is realized in which relative displacement in the axial direction (the direction of arrows B1 and B2) is restricted. As a result, when the drive unit 152 is taken out from the driving force transmission mechanism 156 and exchanged with another new drive unit, the piston rod 154 and the cam block 158 can easily and reliably be attached and detached. Thus, working efficiency of the exchange operation is enhanced.

Further, in the aforementioned embodiment, a condition has been described in which the attachment 52 is used for carrying out a hole-punching process with respect to the workpiece W. However, simply by exchanging the attachment 52 with a different type of attachment, machining can be performed on various types of workpieces W by the same punch apparatus 10.

For example, by using an attachment having a blade or cutting part on the distal end of the machining tool portion 60, dividing or shearing of the workpiece W can be carried out. Further, by using an attachment, which is formed with a convex shape on the distal end of the machining tool portion 60, a riveting or bending process can be performed on the workpiece W. Furthermore, by using an attachment, which is formed with a character-shaped or number-shaped protrusion on the surface of the machining tool portion 60, an engraving or stamping process can be carried out with respect to the workpiece W.

In this manner, by loosening the retaining screw 56, which is screw-engaged in the distal end of the rod 16, taking out the attachment 52 installed in the installation hole 54 and replacing it with a different attachment, and retightening the retaining screw 56 in order to fix the different attachment in place, with a single punch apparatus 10, a plurality of process types can be carried out. Therefore, there is no need to prepare different punch apparatus 10, respectively, for each of such different process types, and equipment investments can be suppressed or reduced.

The punch apparatus according to the present invention is not limited to the above embodiment. Various changes and modifications may be made to the embodiment without departing from the scope of the invention as set forth in the appended claims.

The invention claimed is:

1. A punch apparatus comprising:

a body;

a drive unit disposed in the body and having a drive shaft that is displaced in an axial direction;

a rod disposed at a predetermined angle of inclination with respect to a displacement direction of the drive shaft, the rod being disposed displaceably with respect to the body; and a driving force transmission mechanism by which a driving force output by the drive unit is transmitted to the rod, wherein the driving force transmission mechanism comprises a power boosting mechanism including an inclined portion, which is inclined with respect to the displacement direction of the drive shaft, and the rod is pushed by the inclined portion under a driving action of the drive shaft, whereby the rod is displaced in the axial direction while boosting the driving force, and the inclined portion includes a cam groove, which is formed in a block body connected to the drive shaft, and through which a roller connected to the rod is inserted, the cam groove including a first groove hollow, which extends along a first axis that is inclined at an angle of inclination with respect to the displacement direction, and a second groove hollow connected to the first groove hollow and which extends along a second axis that is inclined at an angle of inclination greater than that of the first groove hollow.

2. The punch apparatus according to claim 1, wherein a stopper is disposed in the body on an axis of the rod at a position on an opposite side from a direction in which the rod is pushed.

3. The punch apparatus according to claim 1, wherein the drive unit is detachable from the body.

4. The punch apparatus according to claim 1, wherein an attachment used to perform machining on a workpiece is attachable to and detachable from a distal end of the rod.

5. The punch apparatus according to claim 3, wherein the drive unit comprises a fluid pressure cylinder including a piston that is displaced in the axial direction under supply of a pressure fluid, the drive shaft being connected to the piston.

6. The punch apparatus according to claim 1, wherein a displacement velocity of the rod is changed by changing the angle of inclination of the second axis along which the second groove hollow extends.

7. The punch apparatus according to claim 1, wherein an amount of boosting when the rod is displaced toward the workpiece is changed by changing the angle of inclination of the first axis along which the first groove hollow extends.

8. The punch apparatus according to claim 1, wherein the end of the drive shaft is connected to the block body by a floating mechanism which enables engagement in a state where relative displacement in the axial direction with respect to the block body is limited.

* * * * *